US007032327B1

(12) United States Patent
Tartaglia et al.

(10) Patent No.: US 7,032,327 B1
(45) Date of Patent: Apr. 25, 2006

(54) COLLAPSIBLE FOOTWEAR

(76) Inventors: Maria Tartaglia, 2475 Brickell Ave., 1009, Miami, FL (US) 33129; Anna Beauregard, 1446 Lenox Ave., Apt. 7, Miami Beach, FL (US) 33139

( * ) Notice: Subject to any disclaimer, the term of this patent is extended or adjusted under 35 U.S.C. 154(b) by 0 days.

(21) Appl. No.: 10/844,161

(22) Filed: May 12, 2004

(51) Int. Cl.
*A43B 3/12* (2006.01)

(52) U.S. Cl. ..... 36/11.5; 36/9 R; 36/102

(58) Field of Classification Search ..... 36/102, 36/7.5, 7.6, 8.2, 11.5, 9 R
See application file for complete search history.

(56) References Cited

U.S. PATENT DOCUMENTS 2,252,315 A * 8/1941 Doree ..... 36/9 R
2,490,916 A * 12/1949 Miller ..... 36/9 R
4,872,273 A * 10/1989 Smeed ..... 36/135
4,944,099 A * 7/1990 Davis ..... 36/97
4,967,491 A * 11/1990 Plotkin ..... 36/7.1 R
6,634,121 B1 * 10/2003 Sordi ..... 36/102
6,836,976 B1 * 1/2005 Haugland ..... 36/10
2002/0078598 A1 * 6/2002 Bell ..... 36/59 R
2004/0000070 A1 * 1/2004 Wright et al. ..... 36/11.5
2004/0068890 A1 * 4/2004 Palahnuk ..... 36/7.1 R

* cited by examiner

*Primary Examiner*—Ted Kavanaugh
(74) *Attorney, Agent, or Firm*—Malloy & Malloy, P.A.

(57) ABSTRACT

A footwear assembly structured to be collapsible comprising a sole including a front portion and a rear portion movably interconnected by an intermediate segment. An upper extends along at least a portion of the length of the sole, depending upon the style of the footwear, wherein the upper and the sole are preferably structured to define the sandal configuration which may vary in style. The intermediate portion includes sufficient flexibility to significantly reduce the size of the sandal by folding the sole into a stored orientation defined by the front and rear portions disposed in at least partially overlying relation to one another. A pouch-like container is dimensioned and configured to receive and maintain at least a pair of the sandals on the interior thereof, when in the stored orientation.

19 Claims, 4 Drawing Sheets

COLLAPSIBLE FOOTWEAR

BACKGROUND OF THE INVENTION

1. Field of the Invention

This invention is directed to footwear preferably, but not exclusively, in the form of a sandal and having a collapsible construction. At least one portion of the footwear/sandal is sufficiently flexible to facilitate selective disposition thereof from a normal, operative orientation into a stored orientation of significantly reduced size. Convenient storage and carrying of the footwear, when in the stored orientation, is thereby facilitated.

2. Description of the Related Art

In years past, footwear was primarily considered a necessary article of clothing in order to adequately protect the wearer's feet. However, in more modern times considerably greater attention is paid to the style of a person's shoe and in particular the wide variety of different types of footwear worn by women. In attempts to satisfy the demands of the consuming public, shoe manufacturers and clothing designers have commercially presented footwear intended to be worn in a variety of different environments and/or which are intended to match or complement various types of clothing as well as specific articles of dress.

With this modern era of stylistic awareness came a recognizable increased demand and a resulting increase in prices for a variety of different footwear. As expected, many individuals of more moderate means are not able to acquire a large quantity of different shoe styles. Therefore, in an effort to alleviate problems and disadvantages of this type, shoe manufacturers have attempted to develop and present footwear which are "convertible" and/or include one or more replaceable or adjustable parts. The convertible nature of such footwear was meant to allow shoes of an individual to be converted to and between different styles, thereby alleviating the necessity of acquiring a larger number of shoes.

Attempts of the type described above typically include removable, adjustable or replaceable heels, uppers, and/or other portions of footwear which facilitate a change in appearance, thereby allowing the wearer to utilize the shoe in different environments. However, an apparent lack of commercial success of such changeable or adjustable footwear is evidence of the fact that the consuming public as a whole is not accepting of the complexity, cost, appearance, etc., of these known attempts. Accordingly, in spite of known attempts of the type set forth above, the noted problems and disadvantages associated with a person's need to change one's footwear, sometimes frequently throughout the day, still exist.

Therefore, instead of attempting to design a relatively complicated footwear structure which may be adjusted to change in style and/or purpose, an improved solution is needed. A more practical solution may be to structure footwear to demonstrate a unique versatility relating to portability and a selective, temporary reduction in size. This would enable a user to carry one or more extra pair of shoes which are intended for different uses during a person's everyday activities.

Accordingly, and by way of example only, an individual going to work on a normal business schedule, but intending to attend a different event thereafter, may initially wear more practical, everyday business shoes during the daytime or normal business hours. Later that person may be desirous and changing into more stylistic, decorative and/or comfortable shoes during the evening. As such, an improved footwear assembly could be structured to be selectively disposed between a normal, operable orientation intended for wearing and then be converted into a stored, reduced-size orientation. The reduced size of the stored orientation would facilitate carrying and storage thereof until the improved footwear is intended for use.

Further, such an improved footwear assembly should include structural components which are adaptable to a number of different styles, sizes and configurations thereby enabling the footwear assembly to be readily available for use and wear in a variety of different environments. Finally, such an improved footwear assembly should be simplified in design, structure and use and be capable of being obtained by the consuming public at a reasonable cost.

SUMMARY OF THE INVENTION

The present invention is directed to footwear and preferably, but not necessarily, footwear structured in the form of a sandal or the like. As used herein, the term "sandal" is meant to be interpreted in its broadest sense, and the various structural and operative components of the footwear assembly of the present invention may be readily adapted to define sandals of various styles, as well as footwear other than sandals. Also, the descriptive detailing of the structure of the present invention will be primarily presented with reference to one sandal or like footwear structure. However, it is emphasized that as typically and practically used, a pair of sandals or like footwear structures will be utilized. As such each sandal of a given pair may be equivalently structured, except for conventional differences in configuration which facilitates each of a pair of sandals being adapted for removable securement to a different foot of the wearer.

Accordingly, unique to the footwear assembly of the present invention is the construction thereof which facilitates its storage and carrying in an appropriately dimensioned, configured and possibly decorative container. As indicated above, it is assumed that such a decorative container will be sufficiently structured to hold a pair of sandals or like footwear. Moreover, the portability of the footwear assembly of the present invention is emphasized by its ability to be significantly reduced in size by the selective disposition thereof from a normal or operative orientation into a stored orientation. When in the stored orientation the size of the sandal, at least in terms of its length, is reduced substantially by half. A pair of the sandals, such as when disposed within the decorative pouch or like container, can be carried in the hand of the wearer or alternatively in a purse, pocketbook, backpack or other commonly available facility.

More specifically, each one of the pair of sandals or like footwear of the present invention comprises a sole having a longitudinal and transverse dimension sufficient to support the foot of the wearer. As also set forth above, the overall peripheral configuration of the sole may vary greatly depending on the style, the intended size and use of the sandal and possibly a variety of other factors. In the various preferred embodiments of the present invention the sole comprises a front portion and a rear portion respectively disposed to underlie the front and rear portions of the wearer's foot, when mounted thereon. In addition, the sole includes an intermediate segment disposed between and moveably interconnecting the front and rear portions of the sole. As will be described in greater detail hereinafter, the structuring of at least the intermediate segment is such as to facilitate selective disposition of the sandal between a normal, operative orientation, assumed by the sandal when worn, and the aforementioned stored orientation.

Other structural features of the sandal include an upper secured to the sole and extending outwardly from the outer, upper surface or face thereof. Depending upon the style and the fact that the footwear of the present invention is preferably constructed into a sandal configuration, the upper will extend above at least the front portion of the sole. Being so positioned and configured, the upper provides a sufficiently dimensioned and configured space or volume to receive the foot of the wearer therein. The upper further facilitates the removable, but reliably secure, attachment of the sandal to the foot of the wearer.

As indicated above, the footwear assembly being structured in the configuration of a sandal may include a large variety of different styles, shapes, dimensions, etc. As such, the upper and the sole are cooperatively structured to define these various styles. Accordingly and by way of example only, the upper may also be in the form of a "thong" style, wherein the leading portion thereof corresponds to the location of and at least partially engages the toes of the wearer. Spaced-apart longitudinal segments of the upper extend along and at least partially underneath both sides of the wearer's foot to a location where they are connected to the sole adjacent to the intermediate segment and/or the rear portion thereof. It is again emphasized that the footwear assembly of the present invention is not limited to the two sandal styles as generally outlined above. However, regardless of the style of the sandal or like footwear, the sole still includes the structural and operative components which facilitate the selective disposition of the sandal into the aforementioned stored orientation.

At least one of the preferred embodiments of the present invention also include a heel connected to the undersurface of the sole in corresponding relation to the rear portion thereof. Also, an outer sole segment may also be secured to the undersurface of the sole in corresponding relation to the front portion thereof and preferably in spaced relation to the heel. Moreover, the heel and the outer sole segment may be used in combination with one another or independently of one another. Regardless of their independent or combined usage, a most-preferred embodiment of the present invention comprises the heel and the outer sole segment being formed from a cushioning material having sufficient resiliency, elasticity, etc., to enhance the comfort of the wearer. Such cushioning material may comprise a rubber or similar material. The term "rubber" as used herein is not to be limited to a true, natural rubber, but is intended to be descriptive of any of a plurality of natural or synthetic materials demonstrating sufficient padding and/or cushioning characteristics when the footwear is worn and used in the conventional manner.

As indicated above, at least one distinguishing feature of the present invention is the selective positioning thereof from the normal, operative orientation into the stored orientation. Accordingly, selective positioning of the sandal into the stored orientation is accomplished, at least in part, by the structuring at least the intermediate segment of the sole to have at least a predetermined minimum flexibility sufficient to allow a bending of the intermediate portion. More specifically, when in the stored orientation, the front and rear portions of the sole are folded about the intermediate section into a position where they are disposed in substantially overlapping relation to one another. As such, the significantly reduced size of the sandal, when in the stored orientation, is accomplished by bending the intermediate segment and thereby folding the sandal substantially in-half. The length of the sandal is thereby reduced substantially by half, as will be discussed in greater detail hereinafter.

In the stored orientation, the intermediate segment, having sufficient flexibility, is "bent" an appropriate amount to accomplish the relative overlying position of the front and rear portions. When so positioned these portions may even at least partially confront or contact one another and/or extend outwardly in a generally common direction from the bent intermediate segment. Depending upon the direction of the bend of the intermediate segment, the upper may be disposed between the overlying front and rear portions in a generally sandwiched position there between. In this embodiment of the stored orientation the aforementioned heel and outer sole segment face outwardly from the interiorly located upper. Also, the intermediate segment could be bent in an opposite direction, such that the front and rear portions would still be disposed in overlying relation to one another. However, in this alternate stored orientation the heel and outer sole segment would be interiorly disposed, facing towards one another, and the upper would be located on the exterior of the folded sole.

In further describing the interconnecting intermediate segment, the degree of flexibility thereof may vary significantly dependent, at least in part, on the construction characteristics of the sole and of course the intermediate segment thereof. Such construction characteristics can include, but are not necessarily limited to, the material used in the formation thereof, the size and configuration of the sole and sandal, etc. Therefore, the term "predetermined flexibility" is meant to describe a range of flexibility, wherein the intermediate segment is structured to demonstrate at least a minimum amount of flexibility sufficient to allow the bending thereof and the folding of the front and rear portions into the stored orientation, as generally described above.

Based on the above, it should be recognized that the disadvantages and problems associated with conventionally structured footwear is overcome in the structural and operative features of the footwear assembly of the present invention. As such, the present invention provides for conveniently portable, easily storable, footwear which may assume a variety of different styles, sizes, etc. Accordingly, the versatility of the footwear assembly of the present invention facilitates the use thereof in a variety of different environments thereby adding to its consumer appeal and acceptance.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
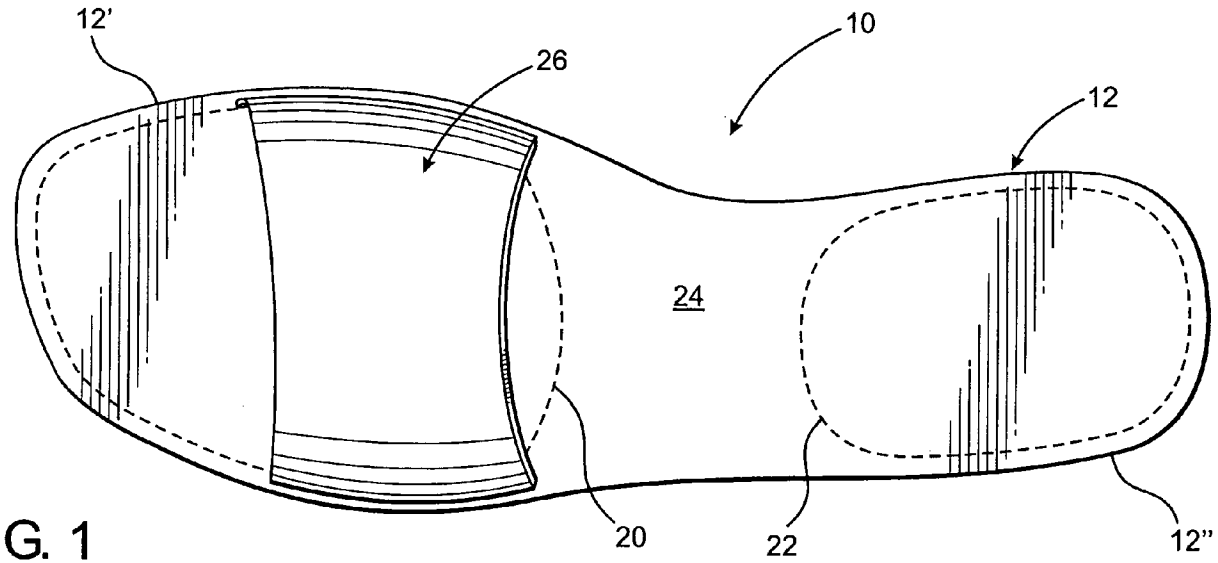
FIG. 1 is a top plan view of one preferred embodiment of the footwear assembly of the present invention in a conventionally operative orientation for wearing.
Figure 2:
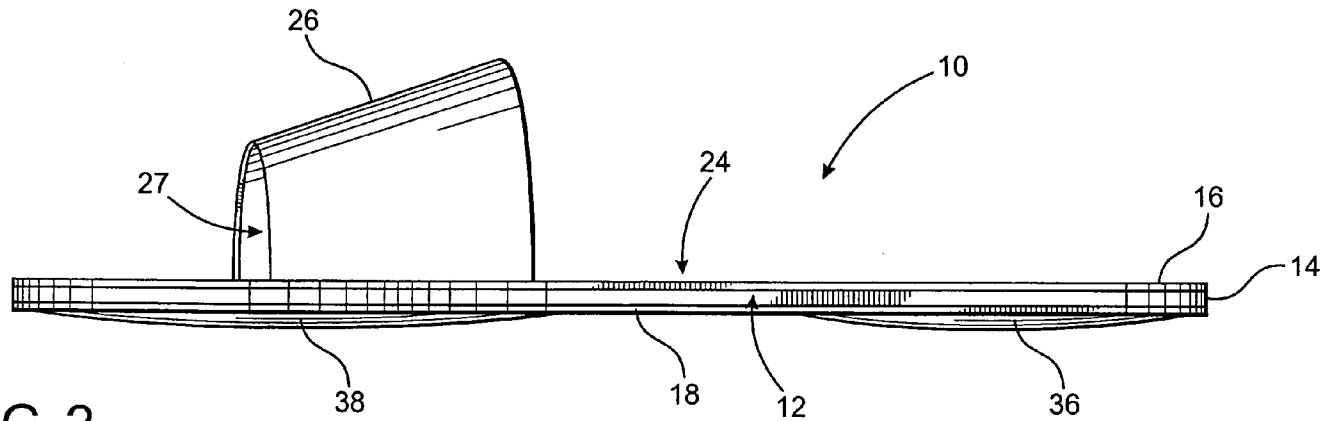
FIG. 2 is a side view of the embodiment of FIG. 1.

As shown in the accompanying drawings, the present invention is directed to a footwear assembly 10 preferably, but not necessarily in the form of a sandal. It is emphasized that in the informative description of the various preferred embodiments of the present invention footwear assembly 10 may comprise a variety of different footwear structures other than the one or more sandal configurations represented in FIGS. 1 through 7. Also, for purposes of clarity, the term "footwear" and "sandal" may be used interchangeably due to the fact that the versatility of the structural components of the present invention and the operative features thereof can be incorporated within the sandal 10 or variety of different footwear structures.

Accordingly, regardless of the specific footwear configuration, the sandal and/or like footwear 10 comprise a sole generally indicated as 12. With primary reference to FIGS. 2 and 4, the sole 12 may include a base 14 sandwiched between an outer facing or surface 16 and an under facing or surface 18. Alternatively, the sole 12 may be of a substantially one-piece construction, wherein the reference numerals 16 and 18 respectively indicate the outer and under surfaces of an integrally formed sole 12. In addition, the sole 12 includes a front portion 20 and a rear portion 22, each of which are schematically represented in phantom lines. It is emphasized that the specific peripheral boundaries indicated by the respective phantom lines of the front and rear portions 20 and 22 are meant to be generally representative of the dimension and configuration of the front and rear portions 20 and 22 and are not meant to be interpreted in a limiting sense. The phantom representation of the front and rear portions 20 and 22 are meant to emphatically demonstrate the general location, size and relative positions of the front and rear portions 20 and 22 rather than the precise boundaries thereof. As an alternative example, both the front and rear portions 20 and 22 may extend laterally outward, so as to coincide with the correspondingly peripheral boundaries of the sole 12 as at 12' and 12".

Moreover, the sole 12 includes an intermediate segment, generally indicated as 24, extending between and moveably interconnecting the front portion 20 and the rear portion 22. As with the front and rear portions 20 and 22, the precise size, disposition and configuration of the intermediate segment 24 may vary significantly based on the size, style, configuration, etc., of the sandal or footwear 10. Also, the intermediate segment 24 serves to moveably interconnect the front and rear portions 20 and 22 of the sole 12, whether the sole 12 has the aforementioned one-piece, integral construction or the multi-layered construction comprising the base 14 and the facings or surfaces 16 and 18.

Figure 3:
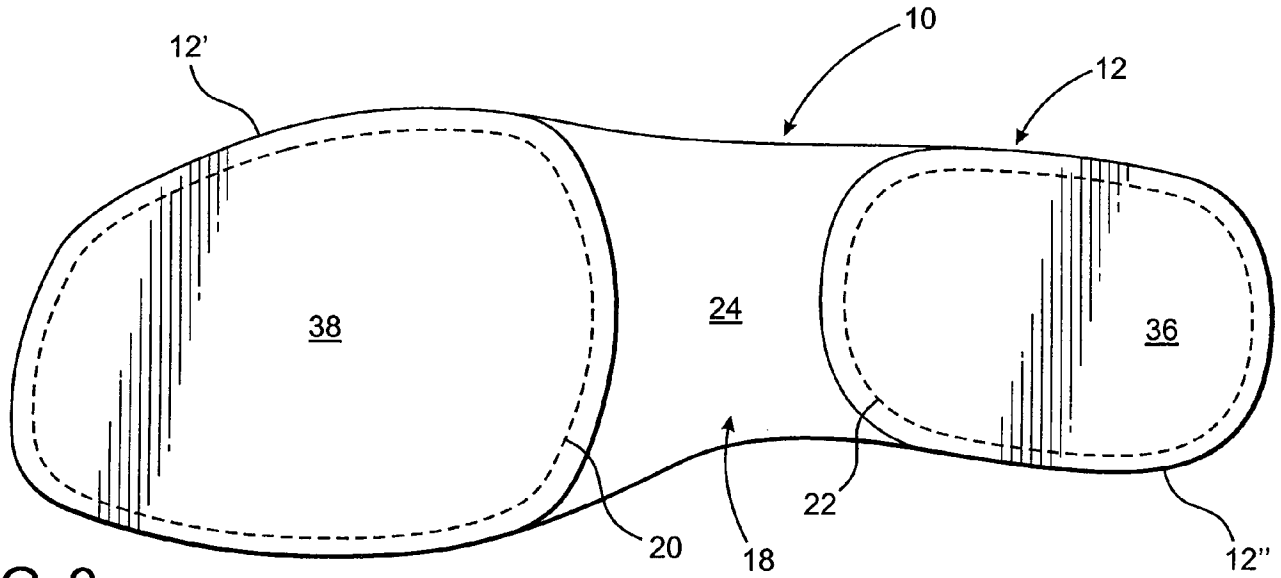
FIG. 3 is a bottom view of the embodiment of FIG. 1 and FIG. 2.
Figure 4:
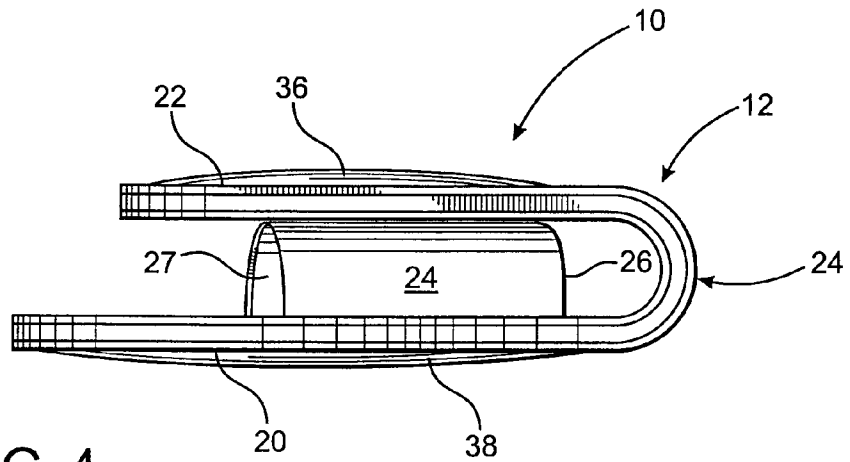
FIG. 4 is a side view of the embodiment of FIGS. 1 through 3 of the footwear assembly of the present invention disposed in a stored orientation.
Figure 5:
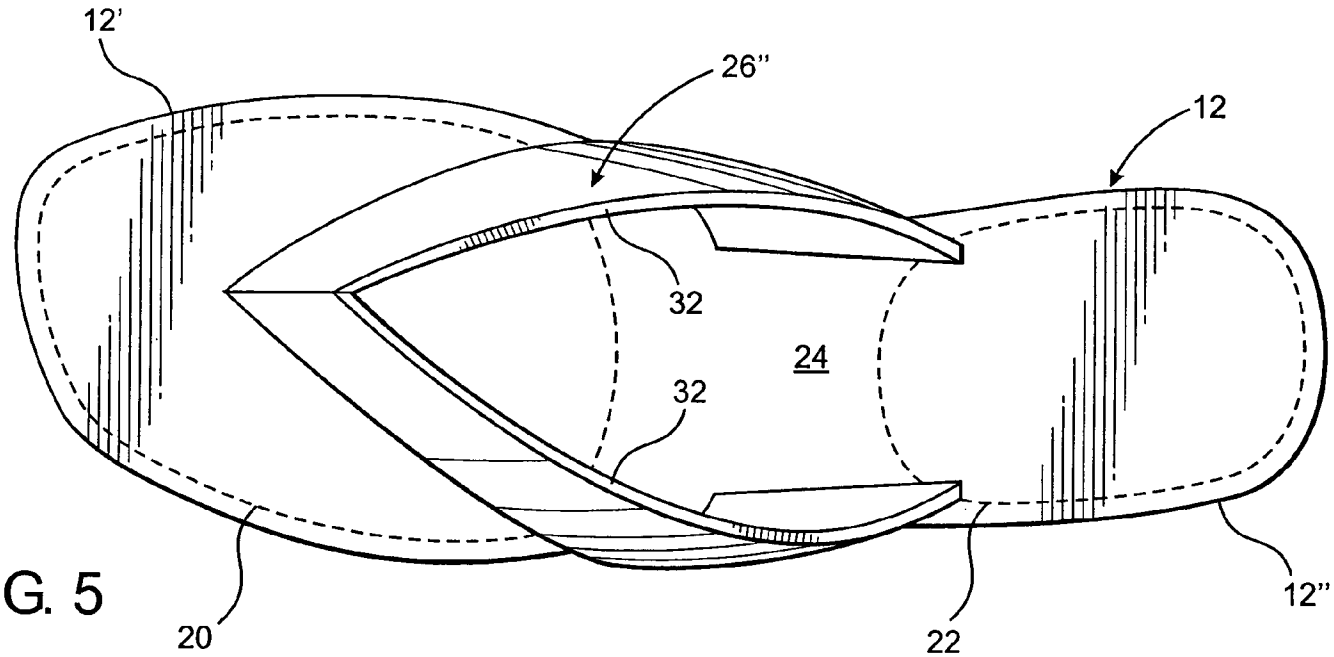
FIG. 5 is top plan view of yet another preferred embodiment of the footwear assembly of the present invention in a conventionally operative orientation.
Figure 6:
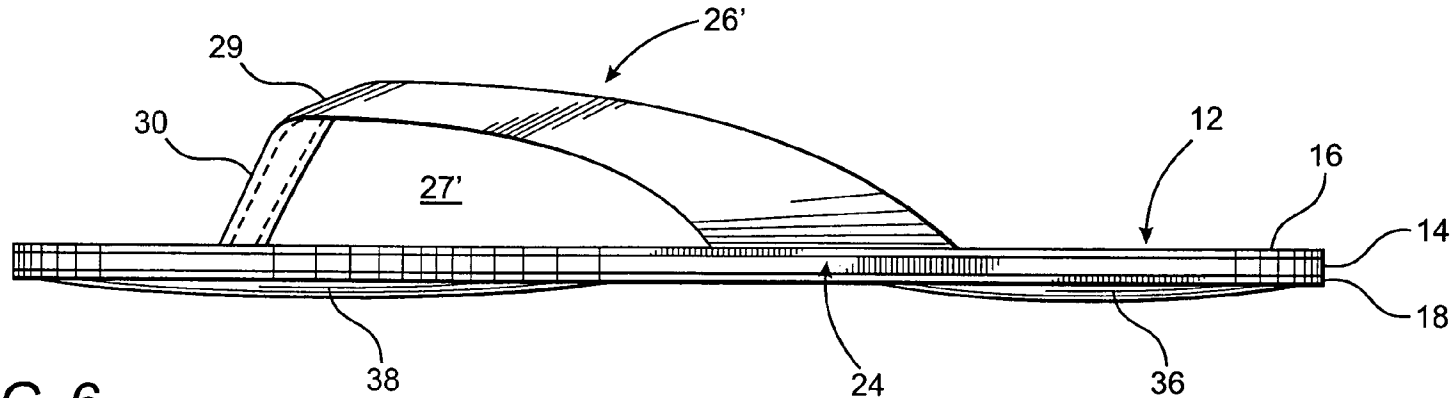
FIG. 6 is a side view of the embodiment of FIG. 5.
Figure 7:
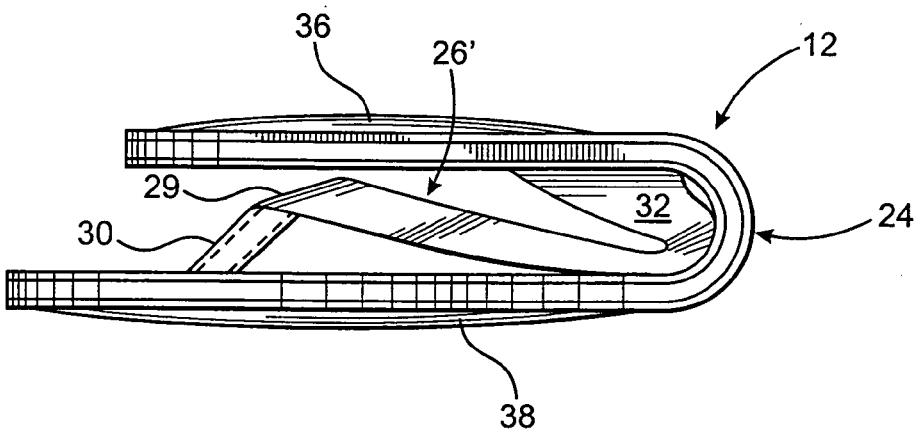
FIG. 7 is a side view of the embodiment of FIGS. 5 and 6 in a stored orientation.
Figure 8:
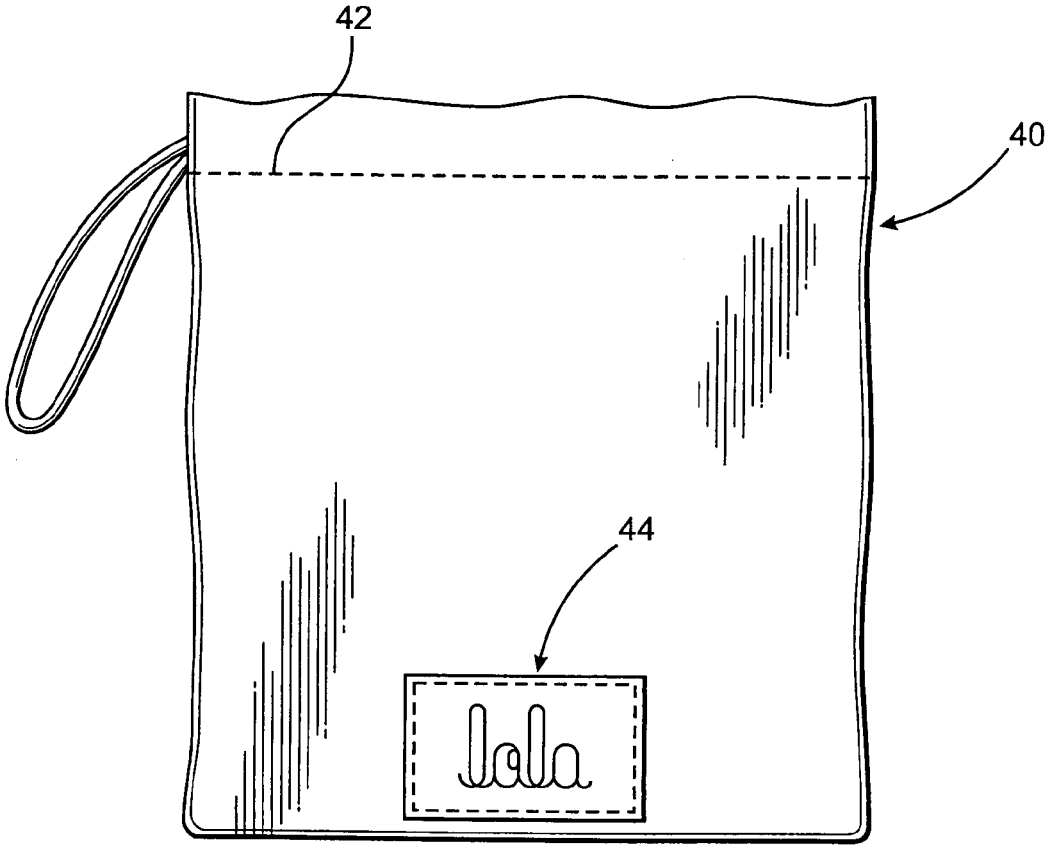
FIG. 8 is a container dimensioned and configured to receive and maintain either of the preferred embodiments of FIGS. 1 through 7 on the interior thereof, preferably when in the stored orientation such as, but not limited to, that demonstrated in FIGS. 4 and 7.

Other structural features of the various preferred embodiments of the present invention include the provision of an upper generally indicated as 26 in the embodiment of FIGS. 1–4 and 26' in the additional preferred embodiment of FIGS. 5–7. The structural difference between the upper 26 and the upper 26' is primarily based on style and a minimal variation in the functioning thereof. More specifically, the upper 26 of the embodiment of FIGS. 1–4 may demonstrate a more common structure associated with a sandal or like footwear 10. As such, the upper 26 is connected to the sole 12 and extends upwardly and/or outwardly from the outer facing or surface 16. The dimension and configuration of the upper 26 is such as to create a space or area 27 in which a corresponding portion of the wearer=s foot passes. In conventional fashion, the uppers 26 and 26' serve to removably secure the sandal 10 to the wearer=s foot. Therefore, the upper 26 extends in covering, somewhat overlying relation to the front portion 20 of the sole 12.

In contrast, the embodiment of FIGS. 5–7 is somewhat more "stylistic" by the upper 26' assuming the configuration of a "thong". Moreover, the upper 26' includes a leading portion 29 connected to the sole 12 by a depending "toe portion" or like structure 30, which passes between the toes of the wearer and also aids in securing the sandal 10 to the wearer's foot. Distinctive features of the thong-type upper 26' include two spaced-apart, longitudinal side portions 32 extending along and at least partially overlying the front portion 20 and the intermediate segment 24, where the side portions 32 are connected to the sole 12. As a result, a foot space or area of foot placement 27' varies significantly from the foot space or area 27 associated with the different embodiments of the uppers 26 and 26, wherein each foot space 27 and 27' includes the opposite ends thereof being open to further define the sandal configuration, as clearly represented in FIGS. 1 through 7.

Other than the difference in the structure of the uppers 26 and 26', the structural and operative features of both the embodiments of FIGS. 1–4 and 5–7 are substantially equivalent. This equivalency in structural and operative components will extend to each of a variety of different styles, sizes, configurations, etc., of the footwear 10 as previously indicated. Also, it should be noted, FIG. 3 represents a bottom view of the sandal 10 and sole 12, wherein the intermediate segment 24 and front and rear portions 20 and 22 respectively are correspondingly indicated. For purposes of clarity, FIG. 3 is meant to represent sole 12 in both of the aforementioned preferred embodiments of FIGS. 1 through 4 and 5 through 7. Also, FIG. 3 is intended to represent each of a larger number of possible embodiments, varying in style, size, configuration, etc.

Additional structural features of each of the preferred embodiments of the present invention preferably include the provision of a heel 36 secured to the facing or surface 18 of the sole 12 and disposed in corresponding relation to the rear portion 22 of the sole 12. In addition, at least one of the preferred embodiments of the present invention may also include an outer sole segment 38 connected to the facing or surface 18 in corresponding relation to the front portion 20. In the normal, operative orientation of FIGS. 2 and 6, the heel 36 underlies the rear portion 22, and the outer sole segment 38 underlies the front portion 20. In a most preferred embodiment, both the heel 36 and the outer sole segment 38 are formed from a cushioning material such as, but not limited to a rubbery-like material. As used herein, the term "rubber" or "rubbery" is not meant to be limited to a natural rubber but can assume any type of natural or synthetic material or composite thereof which provides a sufficient amount of flexibility, resiliency, elasticity, etc., to cushion the foot of the wearer when the sandal or footwear 10 is in use. It should be further noted that the overall construction of the sole 12 may vary to include an integral formation of the heel 36 and/or the outer sole segment 38 on the sole 12. Also, the heel 36 and the outer sole segment 38 may be used in combination with one another as clearly demonstrated or may be used independently of one another if desired.

As emphasized herein, one distinguishing feature of the footwear assembly of the present invention comprises the selective positioning of the sandal or footwear 10, including the sole 12, into a stored orientation represented in FIGS. 4 and 7. Such selective positioning is accomplished by structuring at least the intermediate segment 24 of the sole 12, and possibly additional parts thereof, to have a predetermined flexibility. The predetermined flexibility should be such as to demonstrate at least a minimal degree of flexibility sufficient to accomplish a bending or folding of the intermediate segment 24 into the orientation generally represented in FIGS. 4 and 7. As such, the stored orientation of FIGS. 4 and 7 may be generally described as the front and rear portions 20 and 22 disposed in a generally overlying relation to one another. Constructing the intermediate segment to include the required minium amount of flexibility may include its formation from a leather material or other appropriate durable and at least minimally flexible material. All or at least a portion of the remainder of the sole 12 may also be formed of the same leather or other appropriate material.

Further, when in the stored orientation, the front and rear portions 20 and 22 extend outwardly from the bent intermediate segment 24 in a substantially common direction. It is emphasized that the relative positions of the front and rear portions 20 and 22 may vary from that shown in FIGS. 4 and 7 and still define the stored orientation. By way of example, rather than being substantially parallel as represented, the front and rear portions 20 and 22 may be disposed in a more closely confronting relation to one another and/or be at least partially contacting one another. As further demonstrated in FIGS. 4 and 7 when in the stored orientation, the uppers 26 and/or 26' are preferably disposed on an "interior" of the sole 12 in a somewhat sandwiched relation between the front and rear portions 20 and 22. Alternatively, the intermediate segment 24 may be bent in an opposite direction from that shown in FIGS. 4 and 7. In this alternate stored orientation, the uppers 26 and 26' would be disposed on the exterior of the sole 12, while the heel 36 and outer sole segment 38 would be facing one another on the "interior" of the sole.

Therefore, the stored orientation of the sandal or footwear 10 significantly reduces the size of the sandal 10, at least in terms of reducing its length approximately by half since the front and rear portions 20 and 22 are folded about the intermediate segment in at least partially overlying relation to one another.

To further emphasize the portability, versatility and resulting convenience of the sandal or footwear 10, the present invention may also include the provision of a container generally indicated as 40. The container 40 preferably, but not necessarily, includes a pouch-like structure, having a drawstring or other appropriate closure 42 and being dimensioned and configured to hold at least one of the sandals 10 and more practically a pair thereof. The one or more sandals or like foot wear 10 are disposed on the interior of the container 40 while maintained in the stored orientation, as described. Naturally, the container 10 may vary in type, structure, style, etc. Moreover, the container 40 may include decorative features to enhance the overall aesthetic appearance thereof and may further include a trademark, logo or like advertising and/or decorative field 44.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A footwear assembly having a collapsible construction comprising:

a sole including a front portion, a rear portion and an intermediate segment, said intermediate segment integral with and movably interconnecting said front and rear portions, an outer sole connected to an undersurface of said sole in corresponding relation to said front portion and a heel connected to an undersurface of said sole in corresponding relation to said rear portion, an upper extending along a length of said sole in overlying relation to at least said front portion and in spaced relation to said rear portion to substantially define a sandal configuration, said intermediate segment structured to include a predetermined flexibility sufficient to facilitate disposition of said front and rear portions into a stored orientation, and said stored orientation comprising said front and rear portions folded about said intermediate segment into substantially overlying relation to one another.

2. A footwear assembly as recited in claim 1 wherein said heel and said outer sole are disposed in spaced relation to one another on opposite sides of said intermediate segment.

3. A footwear assembly as recited in claim 1 wherein at least one of said heel and said outer sole are formed of a cushioning material.

4. A footwear assembly as recited in claim 1 wherein said heel and said outer sole are formed from a cushioning material.

5. A footwear assembly as recited in claim 1 wherein said intermediate segment is formed of a leather material structured to include said predetermined flexibility.

6. A footwear assembly as recited in claim 1 wherein said upper is cooperatively structured with said sole to collectively define said sandal configuration, said upper comprising a foot space having oppositely disposed open ends.

7. A footwear assembly as recited in claim 1 wherein said upper is dimensioned and configured to extend along a length of said sole in overlying relation to at least said front portion and said intermediate segment.

8. A footwear assembly having a collapsible construction, said footwear assembly comprising:

a sole including a front portion, a rear portion and an intermediate segment disposed in interconnecting relation between and integrally formed with said front and rear portions, an outer sole connected to an undersurface of said sole in corresponding relation to said front portion and a heel connected to an undersurface of said sole in corresponding relation to said rear portion, an upper connected to said sole and cooperatively structured therewith to define a sandal configuration, said upper comprising a foot space having oppositely disposed open ends further defining said sandal configuration, said intermediate segment structured to include a sufficient flexibility to facilitate disposition of said sole into a stored orientation, and said stored orientation at least partially defined by said sole folded about said intermediate segment, and said front and rear portions disposed into substantially overlapping relation to one another.

9. A footwear assembly as recited in claim 8 further comprising a container disposed and structured to receive and maintain said sole and said upper in said stored orientation.

10. A footwear assembly as recited in claim 8 wherein said stored orientation further comprises at least a portion of said upper disposed between said front and rear portions.

11. A footwear assembly as recited in claim 8 wherein said stored orientation further comprises said front portion and said rear portion disposed in substantially facing relation to one another.

12. A footwear assembly as recited in claim 8 wherein said heel is at least partially formed of a cushioning material and is configured and dimensioned to overlie at least a majority of said rear portion.

13. A footwear assembly as recited in claim 8 wherein said heel and said outer sole segment are disposed in spaced relation to one another on opposite sides of said intermediate segment.

14. A footwear assembly as recited in claim 8 wherein said outer sole segment is formed of a cushioning material.

15. A footwear assembly as recited in claim 14 wherein said heel is at least partially formed of a cushioning material and is configured and dimensioned to overlie at least a majority of said rear portion.

16. A footwear assembly as recited in claim 15 wherein said cushioning material comprises a rubber material.

17. A footwear assembly as recited in claim 8 wherein said intermediate segment is formed of a leather material structured to include said predetermined flexibility.

18. A footwear assembly as recited in claim 8 wherein said upper is dimensioned and configured to extend along a length of said sole in overlying relation to at least said front portion.

19. A footwear assembly as recited in claim 8 wherein said upper is dimensioned and configured to extend along a length of said sole in overlying relation to at least said front portion and said intermediate segment.

* * * * *